US010650841B2

(12) United States Patent
Mitsufuji

(10) Patent No.: US 10,650,841 B2
(45) Date of Patent: May 12, 2020

(54) SOUND SOURCE SEPARATION APPARATUS AND METHOD

(71) Applicant: SONY CORPORATION, Tokyo (JP)

(72) Inventor: Yuhki Mitsufuji, Tokyo (JP)

(73) Assignee: SONY CORPORATION, Tokyo (JP)

( * ) Notice: Subject to any disclaimer, the term of this patent is extended or adjusted under 35 U.S.C. 154(b) by 0 days.

(21) Appl. No.: 15/558,259

(22) PCT Filed: Mar. 9, 2016

(86) PCT No.: PCT/JP2016/057278
§ 371 (c)(1),
(2) Date: Sep. 14, 2017

(87) PCT Pub. No.: WO2016/152511
PCT Pub. Date: Sep. 29, 2016

(65) Prior Publication Data

US 2018/0047407 A1 Feb. 15, 2018

(30) Foreign Application Priority Data

Mar. 23, 2015 (JP) ..... 2015-059318

(51) Int. Cl.
*G10L 21/028* (2013.01)
*G10L 21/0272* (2013.01)
(Continued)

(52) U.S. Cl.
CPC ..... *G10L 21/028* (2013.01); *G10L 21/0272* (2013.01); *H04R 1/406* (2013.01);
(Continued)

(58) Field of Classification Search
None
See application file for complete search history.

(56) References Cited

U.S. PATENT DOCUMENTS

2009/0279715 A1* 11/2009 Jeong ..... H04R 3/005 381/92
2011/0022361 A1* 1/2011 Sekiya ..... G10L 21/0272 702/190

(Continued)

FOREIGN PATENT DOCUMENTS

JP 2006-201496 A 8/2006

OTHER PUBLICATIONS

Naono, et al., "A Design of Array-Microphone System Using Directional Microphones and Two-Dimensional FIR Filters", The Transactions of the Institute of Electronics, Information and Communication Engineers, The IEICE Transections on Fundamentals of Electronics, Communications and Computer Sciences, Japanese, Oct. 1, 2005, vol.J88-A, No. 10, pp. 1109-1120.

(Continued)

*Primary Examiner* — Kenny H Truong
(74) *Attorney, Agent, or Firm* — Chip Law Group

(57) ABSTRACT

The present technology relates to a sound source separation apparatus and a method which make it possible to separate a sound source at lower calculation cost. A communication unit receives a spatial frequency spectrum of a sound collection signal which is obtained by a microphone array collecting a plane wave of sound from a sound source, and a spatial frequency mask generating unit generates a spatial frequency mask for masking a component of a predetermined region in a spatial frequency domain on the basis of the spatial frequency spectrum. A sound source separating unit extracts a component of a desired sound source from the spatial frequency spectrum as an estimated sound source spectrum on the basis of the spatial frequency mask. The present technology can be applied to a spatial frequency sound source separator.

9 Claims, 7 Drawing Sheets

(51) Int. Cl.
*H04R 1/40* (2006.01)
*H04R 3/00* (2006.01)
*G10L 21/0216* (2013.01)

(52) U.S. Cl.
CPC .... *H04R 3/005* (2013.01); *G10L 2021/02166* (2013.01); *H04S 2400/11* (2013.01); *H04S 2420/07* (2013.01); *H04S 2420/13* (2013.01)

(56) References Cited

U.S. PATENT DOCUMENTS

2012/0250913 A1* 10/2012 Sander ..... H04R 1/1083 381/309
2012/0316869 A1* 12/2012 Xiang ..... H04K 1/02 704/226
2016/0071526 A1* 3/2016 Wingate ..... G10L 21/028 704/233

OTHER PUBLICATIONS

Nishikawa, et al., "Analysis of Wider-Band Directional Array Speaker and Microphone in the Two-Dimensional Frequency Area", The Transactions of the Institute of Electronics, Information and Communication Engineers, The IEICE Transections on Fundamentals of Electronics, Communications and Computer Sciences, Japanese, Oct. 1, 2004, vol.J87-A, No. 10, pp. 1358-1359.
Nikunen, et al., "Direction of Arrival Based Spatial Covariance Model for Blind Sound Source Separation", IEEE Transactions on Audio, Speech and Language Processing, 14 pages.
Sawada, et al., "Multichannel Extensions of Non-Negative Matrix Factorization With Complex-Valued Data", IEEE Transactions on Audio, Speech and Language Processing, vol. 21, No. 5, May 2013, pp. 971-982.
International Search Report and Written Opinion of PCT Application No. PCT/JP2016/057278, dated May 24, 2016, 09 pages of ISRWO.
Nikunen, et al., "Direction of Arrival Based Spatial Covariance Model for Blind Sound Source Separation", IEEE/ACM Transactions on Audio, Speech, and Language Processing, vol. 22, No. 3, Mar. 2014, pp. 727-739.
Naono, et al., "A Design of Array-Microphone System Using Directional Microphones and Two-Dimensional FIR Filters", vol. J88-A, No. 10, 2005, pp. 1109-1121.
Kiyoshi Nishikawa, "Analysis of Wider-Band Directional Array Speaker and Microphone in the Two-Dimensional Frequency Area", vol. J87-A, No. 10, 2004, pp. 1358-1361.

* cited by examiner

SOUND SOURCE SEPARATION APPARATUS AND METHOD

CROSS REFERENCE TO RELATED APPLICATIONS

This application is a U.S. National Phase of International Patent Application No. PCT/JP2016/057278 filed on Mar. 9, 2016, which claims priority benefit of Japanese Patent Application No. JP 2015-059318 filed in the Japan Patent Office on Mar. 23, 2015. Each of the above-referenced applications is hereby incorporated herein by reference in its entirety.

TECHNICAL FIELD

The present technology relates to a sound source separation apparatus and method, and a program, and, more particularly, to a sound source separation apparatus and method, and a program which enable a sound source to be separated at lower cost.

BACKGROUND ART

In the past, a wavefront synthesis technology is known which collects sound wavefront using a microphone array formed with a plurality of microphones in sound collection space and reproduces sound using a speaker array formed with a plurality of speakers on the basis of obtained multichannel sound signals. Upon reproduction of sound, sound is separated as necessary so that only sound from a desired sound source is reproduced.

For example, as a sound source separation technology, a minimum variance beam former, multichannel nonnegative martrix factorization (NMF) (nonnegative matrix factorization), or the like, which estimate a time-frequency mask using an inverse matrix of a microphone correlation matrix formed with elements indicating correlation between microphones, that is, between channels, are known (for example, see Non-Patent Literature 1 and Non-Patent Literature 2).

By utilizing such a sound source separation technology, it is possible to extract and reproduce only sound from a desired sound source using a time-frequency mask.

CITATION LIST

Non-Patent Literature

Non-Patent Literature 1: Hiroshi Sawada, Hirokazu Kameoka, Shoko Araki, Naonori Ueda, "Multichannel Extensions of Non-Negative Matrix Factorization With Complex-Valued Data," IEEE Transactions on Audio, Speech & Language Processing 21(5): 971-982 (2013)

Non-Patent Literature 2: Joonas Nikunen, Tuomas Virtanen, "Direction of Arrival Based Spatial Covariance Model for Blind Sound Source Separation," IEEE/ACM Transactions on Audio, Speech & Language Processing 22(3): 727-739 (2014)

DISCLOSURE OF INVENTION

Technical Problem

However, with the above-described technology, if the number of microphones constituting a microphone array increases, calculation cost of an inverse matrix of a microphone correlation matrix increases.

Sound source separation of a multichannel sound signal in related art is directed to a case where the number of microphones $N_{mic}$ is approximately between 2 and 16. Therefore, optimization calculation of sound source separation for a multichannel sound signal observed at a large-scale microphone array whose number of microphones $N_{mic}$ is equal to or larger than 32 requires enormous calculation cost.

For example, in a method using multichannel NMF disclosed in Non-Patent Literature 1, cost $O(N_{mic}^3)$ required for calculation of an inverse matrix of a microphone correlation matrix is a bottleneck of optimization calculation. Specifically, for example, an optimization calculation period in the case where the number of microphones $N_{mic}=32$ is $2^{12}(=(2^5)^3/2^3)$ of a calculation period in the case where the number of microphones $N_{mic}=2$.

The present technology has been made in view of such circumstances, and is directed to separating a sound source at lower calculation cost.

Solution to Problem

A sound source separation apparatus according to an aspect of the present technology includes: an acquiring unit configured to acquire a spatial frequency spectrum of a multichannel sound signal obtained by collecting sound using a microphone array; a spatial frequency mask generating unit configured to generate a spatial frequency mask for masking a component of a predetermined region in a spatial frequency domain on the basis of the spatial frequency spectrum; and a sound source separating unit configured to extract a component of a desired sound source from the spatial frequency spectrum as an estimated sound source spectrum on the basis of the spatial frequency mask.

The spatial frequency mask generating unit may generate the spatial frequency mask through blind sound source separation.

The spatial frequency mask generating unit may generate the spatial frequency mask through the blind sound source separation utilizing nonnegative matrix factorization.

The spatial frequency mask generating unit may generate the spatial frequency mask through sound source separation using information relating to the desired sound source.

The information relating to the desired sound source may be information indicating a direction of the desired sound source.

The spatial frequency mask generating unit may generate the spatial frequency mask using an adaptive beam former.

The sound source separation apparatus may further include: a drive signal generating unit configured to generate a drive signal in a spatial frequency domain for reproducing sound based on the sound signal on the basis of the estimated sound source spectrum; a spatial frequency synthesis unit configured to perform spatial frequency synthesis on the drive signal to calculate a time-frequency spectrum; and a time-frequency synthesis unit configured to perform time-frequency synthesis on the time-frequency spectrum to generate a speaker drive signal for reproducing the sound using a speaker array.

A sound source separation method or a program according to an aspect of the present technology includes the steps of: acquiring a spatial frequency spectrum of a multichannel sound signal obtained by collecting sound using a microphone array; generating a spatial frequency mask for masking a component of a predetermined region in a spatial frequency domain on the basis of the spatial frequency spectrum; and extracting a component of a desired sound source from the spatial frequency spectrum as an estimated sound source spectrum on the basis of the spatial frequency mask.

According to an aspect of the present technology, a spatial frequency spectrum of a multichannel sound signal obtained by collecting sound using a microphone array is acquired; a spatial frequency mask for masking a component of a predetermined region in a spatial frequency domain is generated on the basis of the spatial frequency spectrum; and a component of a desired sound source from the spatial frequency spectrum is extracted as an estimated sound source spectrum on the basis of the spatial frequency mask.

Advantageous Effects of Invention

According to one aspect of the present technology, it is possible to separate a sound source at lower calculation cost.

Note that advantageous effects of the present technology are not limited to those described here and may be any advantageous effect described in the present disclosure.

MODES FOR CARRYING OUT THE INVENTION

Embodiments to which the present technology is applied will be described below with reference to the drawings.

<First Embodiment>

<Outline of Present Technology>

The present technology relates to a sound source separation apparatus which expands a multichannel sound collection signal obtained by collecting sound using a microphone array formed with a plurality of microphones to a spatial frequency using an orthonormal base such as a Fourier base and a spherical harmonic base and separates a sound source using a spatial frequency mask.

Figure 1:
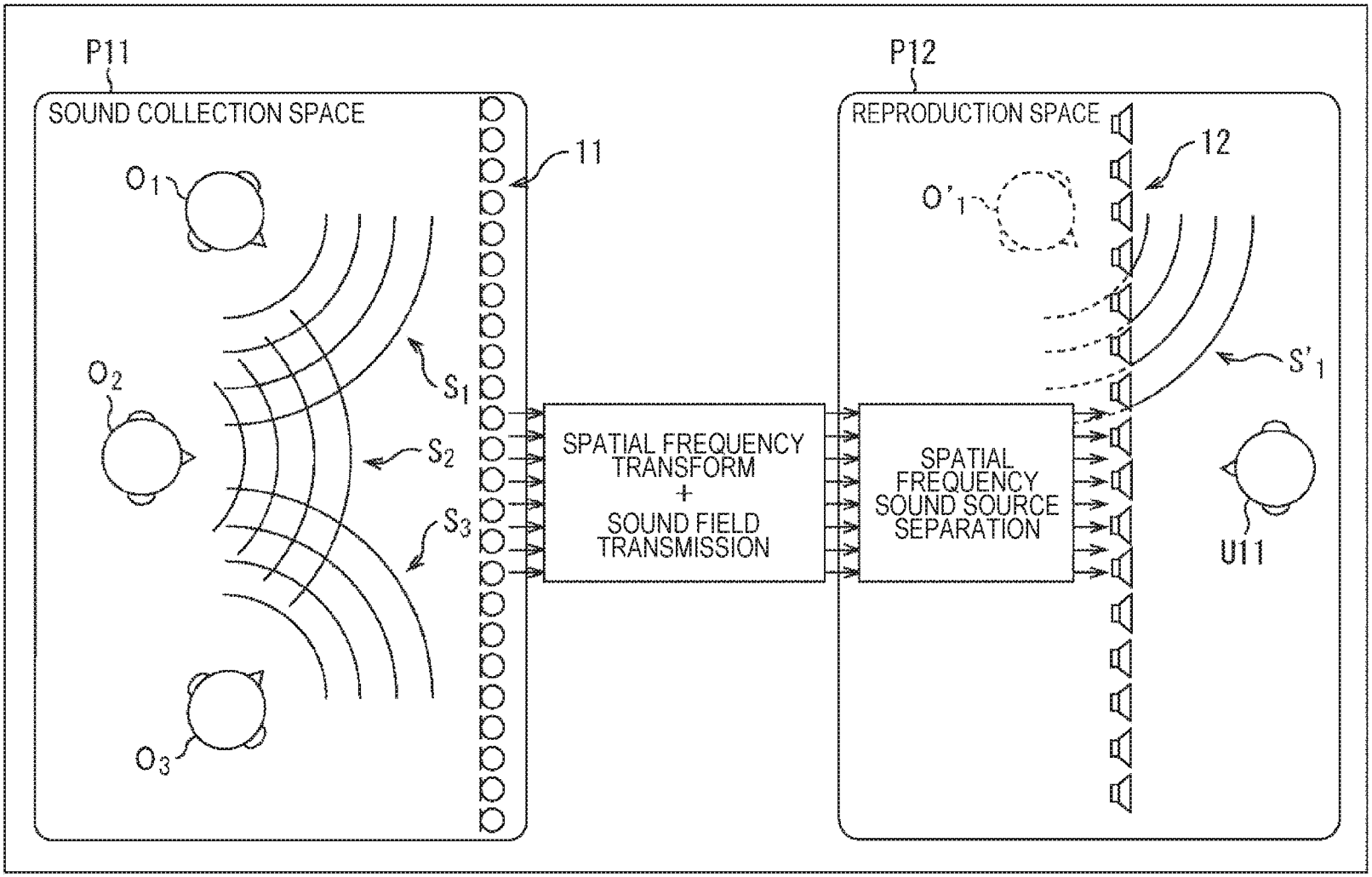
FIG. 1 is a diagram explaining outline of the present technology.

For example, as illustrated in FIG. 1, such a technology can be applied to a case where sound from a plurality of sound sources is collected in sound collection space and arbitrary only one or more sound sources are extracted among these plurality of sound sources.

In FIG. 1, a sound field of sound collection space P11 is reproduced in reproduction space P12.

In the sound collection space P11, for example, a linear microphone array 11 formed with a comparatively large number of microphones disposed in a linear fashion is disposed.

Further, sound sources $O_1$ to $O_3$ which are speakers exist in the sound collection space P11, and the linear microphone array 11 collects sound of propagation waves $S_1$ to $S_3$ which are sound respectively emitted from these sound sources $O_1$ to $O_3$. That is, at the linear microphone array 11, a multichannel sound collection signal in which the propagation waves $S_1$ to $S_3$ are mixed is observed.

The multichannel sound collection signal obtained in this manner is transformed into a signal in a spatial frequency domain through spatial frequency transform, compressed by bits being preferentially allocated to a time-frequency band and a spatial frequency band which are important for reproducing a sound field, and transmitted to the reproduction space P12.

Further, in the reproduction space P12, a linear speaker array 12 formed with a comparatively large number of speakers disposed in a linear fashion is disposed, and a listener U11 who listens to reproduced sound exists.

In the reproduction space P12, the sound collection signal in a spatial frequency domain transmitted from the sound collection space P11 is separated into a plurality of sound sources $O'_1$ to $O'_3$ using the spatial frequency mask, and sound is reproduced on the basis of a signal of a sound source arbitrarily selected from these sound sources $O'_1$ to $O'_3$. That is, a sound field of the sound collection space P11 is reproduced by only a desired sound source being selected.

In this example, the sound source $O'_1$ corresponding to the sound source $O_1$ is selected, and a propagation wave $S'_1$ of the sound source $O'_1$ is output. By this means, the listener U11 listens to only sound of the sound source $O'_1$.

Note that, while an example where a microphone array which collects sound is the linear microphone array 11 has been described here, any microphone array such as a planar microphone array, a spherical microphone array and a circular microphone array other than the linear microphone array may be used as the microphone array if the microphone array is configured with a plurality of microphones. In a similar manner, while an example where a speaker array which outputs sound is the linear speaker array 12 has been described, any speaker array such as a planar speaker array, a spherical speaker array and a circular speaker array other than the linear speaker array may be used as the speaker array.

Figure 2:
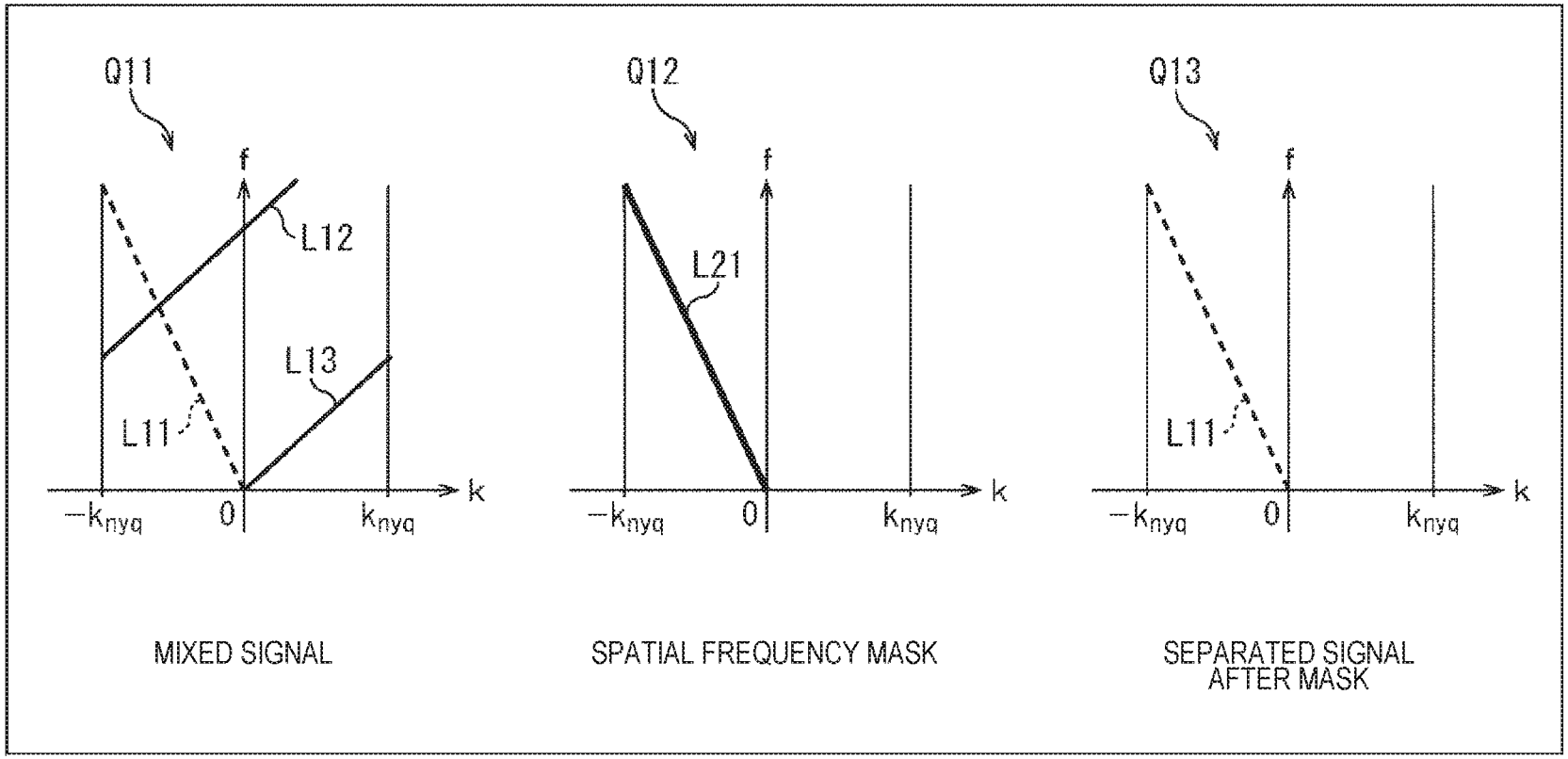
FIG. 2 is a diagram explaining a spatial frequency mask.

While, in the present technology, sound is separated using a spatial frequency mask, for example, as illustrated in FIG. 2, the spatial frequency mask masks only a component of a desired region in a spatial frequency domain, that is, a sound component from a desired direction in the sound collection space and removes other components. Note that FIG. 2 indicates a time-frequency f on a vertical axis and indicates a spatial frequency k on a horizontal axis. Further, $k_{nyq}$ is a spatial Nyquist frequency.

For example, in the sound collection space P11, it is assumed that sound is collected from two sound sources using the linear microphone array 11 and the sound collection signal obtained as a result of the sound collection is subjected to spatial frequency analysis. It is assumed that, as a result of the analysis, in a spatial spectrum (angular spectrum) of the sound collection signal, as indicated with an arrow Q11, a spectral peak indicated with lines L11 to L13 is observed.

Here, it is assumed that the spectral peak indicated with the line L11 is a spectral peak of a propagation wave of a desired sound source, and the spectral peak indicated with the line L12 and the line L13 is a spectral peak of a propagation wave of an unnecessary sound source.

In this case, in the present technology, for example, as indicated with an arrow Q12, a spatial frequency mask is generated, which masks only a region where a spectral peak of a propagation wave of a desired sound source will appear in a spatial frequency domain, that is, in a spatial spectrum, and removes (blocks) components of other regions which are not masked.

In the example illustrated in the arrow Q12, a line L21 indicates a spatial frequency mask, and this spatial frequency mask indicates a component corresponding to a propagation wave of a desired sound source. A region to be masked in the spatial spectrum is determined in accordance with positional relationship between the sound source and the linear microphone array 11 in the sound collection space, that is, an arrival direction of a propagation wave from the sound source to the linear microphone array 11.

If a spatial frequency spectrum of the sound collection signal obtained through spatial frequency analysis is multiplied by such a spatial frequency mask, only a component on the line L21 is extracted, so that a spatial spectrum indicated with an arrow Q13 is obtained. That is, only a sound component from a desired sound source is extracted. In this example, a component corresponding to the spectral peak indicated with the line L12 and the line L13 is removed, and only a component corresponding to the spectral peak indicated with the line L11 is extracted.

While, for example, sound source separation which estimates a time-frequency mask instead of a spatial frequency mask, using an inverse matrix of a microphone correlation matrix is known, in such sound source separation, calculation cost of the time-frequency mask increases as the number of microphones of the microphone array increases.

Meanwhile, as in the present technology, by performing spatial frequency transform on the sound collection signal using an orthonormal base such as a Fourier base, because the microphone correlation matrix is diagonalized and a non-diagonal component approaches zero, the inverse matrix is simply calculated as a triple diagonal inverse matrix or a diagonal inverse matrix. Therefore, according to the present technology, it is possible to expect significant reduction of a calculation amount without impairing performance of sound source separation. That is, according to the present technology, it is possible to separate a sound source at lower calculation cost.

<Configuration Example of Spatial Frequency Sound Source Separator>

A specific embodiment in which the present technology is applied will be described next as an example where the present technology is applied to a spatial frequency sound source separator.

Figure 3:
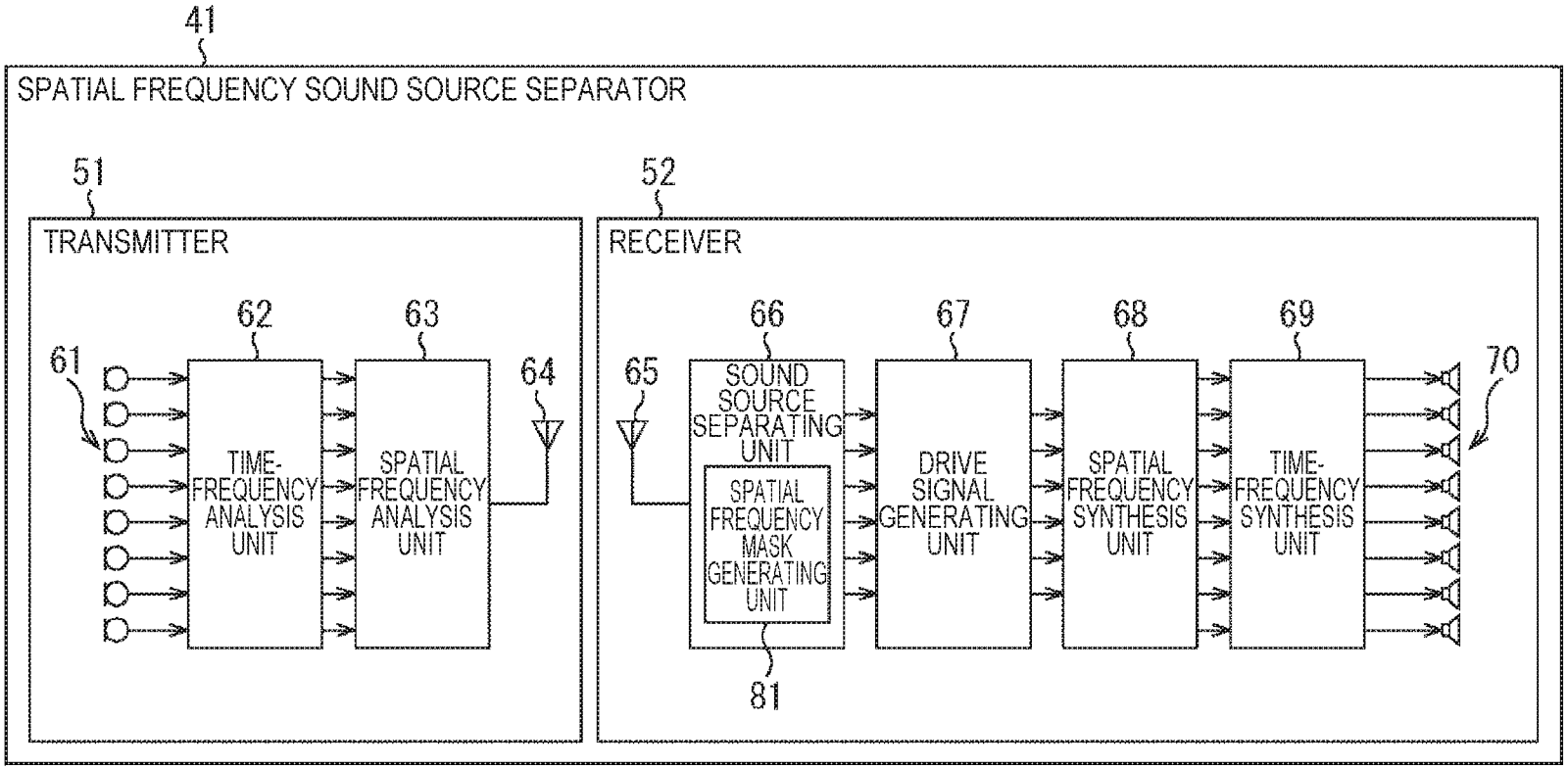
FIG. 3 is a diagram illustrating a configuration example of a spatial frequency sound source separator.

FIG. 3 is a diagram illustrating a configuration example of an embodiment of the spatial frequency sound source separator to which the present technology is applied.

The spatial frequency sound source separator 41 has a transmitter 51 and a receiver 52. In this example, for example, the transmitter 51 is disposed in sound collection space where a sound field is to be collected, and the receiver 52 is disposed in reproduction space where the sound field collected in the sound collection space is to be reproduced.

The transmitter 51 collects a sound field, generates a spatial frequency spectrum from a sound collection signal which is a multichannel sound signal obtained through sound collection and transmits the spatial frequency spectrum to the receiver 52. The receiver 52 receives the spatial frequency spectrum transmitted from the transmitter 51, generates a speaker drive signal and reproduces the sound field on the basis of the obtained speaker drive signal.

The transmitter 51 has a microphone array 61, a time-frequency analysis unit 62, a spatial frequency analysis unit 63 and a communication unit 64. Further, the receiver 52 has a communication unit 65, a sound source separating unit 66, a drive signal generating unit 67, a spatial frequency synthesis unit 68, a time-frequency synthesis unit 69 and a speaker array 70.

The microphone array 61, which is, for example, a linear microphone array formed with a plurality of microphones disposed in a linear fashion, collects a plane wave of arriving sound and supplies a sound collection signal obtained at each microphone as a result of the sound collection to the time-frequency analysis unit 62.

The time-frequency analysis unit 62 performs time-frequency transform on the sound collection signal supplied from the microphone array 61 and supplies a time-frequency spectrum obtained as a result of the time-frequency transform to the spatial frequency analysis unit 63. The spatial frequency analysis unit 63 performs spatial frequency transform on the time-frequency spectrum supplied from the time-frequency analysis unit 62 and supplies a spatial frequency spectrum obtained as a result of the spatial frequency transform to the communication unit 64.

The communication unit 64 transmits the spatial frequency spectrum supplied from the spatial frequency analysis unit 63 to the communication unit 65 of the receiver 52 in a wired or wireless manner.

Further, the communication unit 65 of the receiver 52 receives the spatial frequency spectrum transmitted from the communication unit 64 and supplies the spatial frequency spectrum to the sound source separating unit 66.

The sound source separating unit 66 extracts a component of a desired sound source from the spatial frequency spectrum supplied from the communication unit 65 as an estimated sound source spectrum through blind sound source separation and supplies the estimated sound source spectrum to the drive signal generating unit 67.

Further, the sound source separating unit 66 has a spatial frequency mask generating unit 81, and the spatial frequency mask generating unit 81 generates a spatial frequency mask through nonnegative matrix factorization on the basis of the spatial frequency spectrum supplied from the communication unit 65 upon blind sound source separation. The sound source separating unit 66 extracts the estimated sound source spectrum using the spatial frequency mask generated in this manner.

The drive signal generating unit 67 generates a speaker drive signal in a spatial frequency domain for reproducing the collected sound field on the basis of the estimated sound source spectrum supplied from the sound source separating unit 66 and supplies the speaker drive signal to the spatial frequency synthesis unit 68. In other words, the drive signal generating unit 67 generates a speaker drive signal in a spatial frequency domain for reproducing sound on the basis of the sound collection signal.

The spatial frequency synthesis unit 68 performs spatial frequency synthesis on the speaker drive signal supplied from the drive signal generating unit 67 and supplies a time-frequency spectrum obtained as a result of the spatial frequency synthesis to the time-frequency synthesis unit 69.

The time-frequency synthesis unit 69 performs time-frequency synthesis on the time-frequency spectrum supplied from the spatial frequency synthesis unit 68 and supplies a speaker drive signal obtained as a result of the time-frequency synthesis to the speaker array 70. The speaker array 70, which is, for example, a linear speaker array formed with a plurality of speakers disposed in a linear fashion, reproduces sound on the basis of the speaker drive signal supplied from the time-frequency synthesis unit 69. By this means, the sound field in the sound collection space is reproduced.

Here, units constituting the spatial frequency sound source separator 41 will be described in detail.

(Time-Frequency Analysis Unit)

The time-frequency analysis unit 62 analyzes time-frequency information of sound collection signals $s(n_{mic}, t)$ obtained at respective microphones constituting the microphone array 61.

However, $n_{mic}$ in the sound collection signals $s(n_{mic}, t)$ are microphone indexes indicating microphones constituting the microphone array 61, and the microphone indexes $n_{mic}=0, \ldots, N_{mic}-1$. Here, $N_{mic}$ is the number of microphones constituting the microphone array 61. Further, in the sound collection signal $s(n_{mic}, t)$, t indicates time.

The time-frequency analysis unit 62 performs time frame division of a fixed size on the sound collection signal $s(n_{mic}, t)$ to obtain an input frame signal $s_{fr}(n_{mic}, n_{fr}, 1)$. The time-frequency analysis unit 62 then multiplies the input frame signal $s_{fr}(n_{mic}, n_{fr}, 1)$ by a window function $w_T(n_{fr})$ indicated in the following equation (1) to obtain a window function applied signal $s_w(n_{mic}, n_{fr}, 1)$. That is, calculation in the following equation (2) is performed to calculate the window function applied signal $s_w(n_{mic}, n_{fr}, 1)$.

[Math. 1]

$$w_T(n_{fr}) = \left(0.5 - 0.5\cos\left(2\pi\frac{n_{fr}}{N_{fr}}\right)\right)^{0.5} \tag{1}$$

[Math. 2]

$$s_w(n_{mic}, n_{fr}, 1) = w_T(n_{fr}) s_{fr}(n_{mic}, n_{fr}, 1) \tag{2}$$

Here, in the equation (1) and the equation (2), $n_{fr}$ indicates a time index which shows samples within a time frame, and the time index $n_{fr}=0, \ldots, N_{fr}-1$. Further, I indicates a time frame index, and the time frame index $I=0, \ldots, L-1$. Note that $N_{fr}$ is a frame size (the number of samples in a time frame), and L is the total number of frames.

Further, the frame size $N_{fr}$ is the number of samples $N_{fr}(=R(f_s^T \times T_{fr})$, where R( ) is an arbitrary rounding function) corresponding to time $T_{fr}$[s] in one frame at a time sampling frequency $f_s^T$ [Hz]. While, in the present embodiment, for example, the time in one frame $T_{fr}=1.0$ [s], and the rounding function R( ) is round-off, they may be set differently. Further, while a shift amount of the frame is set at 50% of the frame size $N_{fr}$, it may be set differently.

Still further, while a square root of a Hanning window is used as the window function, other windows such as a Hamming window and a Blackman-Harris window may be used.

When the window function applied signal $s_w(n_{mic}, n_{fr}, 1)$ is obtained in this manner, the time-frequency analysis unit 62 performs time-frequency transform on the window function applied signal $s_w(n_{mic}, n_{fr}, 1)$ by calculating the following equations (3) and (4) to calculate a time-frequency spectrum $S(n_{mic}, n_T, 1)$.

[Math. 3]

$$s'_w(n_{mic}, m_T, l) = \begin{cases} s_w(n_{mic}, m_T, l) & m_T = 0, \ldots, N_{fr}-1 \\ 0 & m_T = N_{fr}, \ldots, M_T - 1 \end{cases} \tag{3}$$

-continued

[Math. 4]

$$S(n_{mic}, n_T, l) = \sum_{m_T=0}^{M_T-1} s'_w(n_{mic}, m_T, l)\exp\left(-i2\pi\frac{m_T n_T}{M_T}\right) \tag{4}$$

That is, a zero padded signal $s'_w(n_{mic}, M_T, 1)$ is obtained through calculation of the equation (3), and equation (4) is calculated on the basis of the obtained zero padded signal $s'_w(n_{mic}, M_T, 1)$ to calculate a time-frequency spectrum $S(n'_{mic}, n_T, 1)$.

Note that, in the equation (3) and the equation (4), $M_T$ indicates the number of points used for time-frequency transform. Further, $n_T$ indicates a time-frequency spectral index. Here, $nT=0, \ldots, N_T-1$, and $N_T=M_T/2+1$. Further, in the equation (4), i indicates a pure imaginary number.

Further, while, in the present embodiment, time-frequency transform using short time Fourier transform (STFT) is performed, other time-frequency transform such as discrete cosine transform (DCT) and modified discrete cosine transform (MDCT) may be used.

Still further, while the number of points MT of STFT is set at a power-of-two value closest to Nfr, which is equal to or larger than Nfr, other number of points MT may be used.

The time-frequency analysis unit 62 supplies the time-frequency spectrum S(nmic, nT, 1) obtained through the above-described processing to the spatial frequency analysis unit 63.

(Spatial Frequency Analysis Unit)

Subsequently, the spatial frequency analysis unit 63 performs spatial frequency transform on the time-frequency spectrum $S(n_{mic}, n_T, 1)$ supplied from the time-frequency analysis unit 62 by calculating the following equation (5) to calculate a spatial frequency spectrum $S'(n_S, n_T, 1)$.

[Math. 5]

$$S'(n_S, n_T, l) = \frac{1}{M_S}\sum_{m_S=0}^{M_S-1} S''(m_S, n_T, l)\exp\left(i2\pi\frac{m_S n_S}{M_S}\right) \tag{5}$$

Note that, in the equation (5), $M_S$ indicates the number of points used for spatial frequency transform, and $m_s=0, \ldots, M_S-1$. Further, $S''(m_S, n_T, 1)$ indicates a zero padded time-frequency spectrum obtained by performing zero padding on the time-frequency spectrum $S(n_{mic}, n_T, 1)$, and i indicates a pure imaginary number. Still further, $n_S$ indicates a spatial frequency spectral index.

In the present embodiment, spatial frequency transform through inverse discrete Fourier transform (IDFT) is performed through calculation of the equation (5).

Further, zero padding may be appropriately performed if necessary in accordance with the number of points $M_S$ of IDFT. In this example, concerning a point ms where $0 \le m_S \le N_{mic}-1$, a zero padded time-frequency spectrum $S''(m_S, n_T, 1)$=a time frequency spectrum $S(n_{mic}, n_T, 1)$, and concerning a point ms where $N_{mic} \le m_S \le M_S-1$, a zero padded time-frequency spectrum $S''(m_S, n_T, 1)=0$.

The spatial frequency spectrum $S'(n_S, n_T, 1)$ obtained through the above-described processing indicates what kind of waveforms a signal of the time-frequency $n_T$ included in a time frame I takes in space. The spatial frequency analysis unit 63 supplies the spatial frequency spectrum $S'(n_S, n_T, 1)$ to the communication unit 64.

Note that, as indicated in the following equation (6) to equation (8), if the spatial frequency spectral matrix is $S'_{nT,1}$, the time-frequency spectral matrix is $S''_{nT,1}$, and a Fourier base matrix is F, calculation of the above-described equation (5) can be expressed with a product of matrixes as indicated in equation (9).

[Math. 6]

$$S'_{nT,1} \in \mathbb{C}^{N_S \times 1} \tag{6}$$

[Math. 7]

$$S''_{nT,1} \in \mathbb{C}^{M_S \times 1} \tag{7}$$

[Math. 8]

$$F \in \mathbb{C}^{M_S \times N_S} \tag{8}$$

[Math. 9]

$$S'_{nT,1} = F^H S''_{nT,1} \tag{9}$$

Here, the spatial frequency spectral matrix $S'_{nT,1}$ is a matrix which has each spatial frequency spectrum $S'(n_S, n_T, 1)$ as an element, and the time-frequency spectral matrix $S''_{nT,1}$ is a matrix which has each zero padded time-frequency spectrum $S''(m_S, n_T, 1)$ as an element.

Further, in the equation (9), $F^H$ indicates a Hermitian transposed matrix of the Fourier base matrix F, and the Fourier base matrix F is a matrix indicated with the following equation (10).

[Math. 10]

$$F = \frac{1}{M_S}\begin{bmatrix} \exp\left(i2\pi\frac{0\times 0}{M_S}\right) & \cdots & \exp\left(i2\pi\frac{0\times(N_S-1)}{M_S}\right) \\ \vdots & \ddots & \vdots \\ \exp\left(i2\pi\frac{(M_S-1)\times 0}{M_S}\right) & \cdots & \exp\left(i2\pi\frac{(M_S-1)\times(N_S-1)}{M_S}\right) \end{bmatrix}. \tag{10}$$

Note that, while the Fourier base matrix F which is a base of a plane wave is used here, in the case where the microphones of the microphone array 61 are disposed on a spherical surface, it is only necessary to use a spherical harmonic base matrix. Further, an optimal base may be obtained and used in accordance with disposition of the microphones.

(Sound Source Separating Unit)

To the sound source separating unit 66, the spatial frequency spectrum $S'(n_S, n_T, 1)$ acquired by the communication unit 65 from the spatial frequency analysis unit 63 via the communication unit 64 is supplied. At the sound source separating unit 66, a spatial frequency mask is estimated from the spatial frequency spectrum $S'(n_S, n_T, 1)$ supplied from the communication unit 65, and a component of a desired sound source is extracted on the basis of the spatial frequency spectrum $S'(n_S, n_T, 1)$ and the spatial frequency mask.

While the sound source separating unit 66 performs blind sound source separation, specifically, for example, the sound source separating unit 66 can perform nonnegative matrix factorization, more specifically, blind sound source separation utilizing nonnegative matrix factorization or nonnegative tensor decomposition.

Here, an example will be described where spatial frequency nonnegative tensor decomposition is performed assuming that the spatial frequency spectrum $S'(n_S, n_T, 1)$ is a three-dimensional tensor, and the three-dimensional tensor is decomposed to K three-dimensional tensors of Rank 1.

Because the three-dimensional tensor of Rank 1 can be decomposed to three types of vectors, by collecting K vectors for each of three types of vectors, three types of matrixes of a frequency matrix T, a time matrix V and a microphone correlation matrix H are generated.

In the spatial frequency nonnegative tensor decomposition, the three-dimensional tensor is decomposed to K three-dimensional tensors by learning these frequency matrix T, time matrix V and microphone correlation matrix H through optimization calculation.

Here, the frequency matrix T represents characteristics regarding K three-dimensional tensors of Rank 1, that is, a time-frequency direction of each base of K three-dimensional tensors, and the time matrix V represents characteristics regarding a time direction of K three-dimensional tensors of Rank 1. Further, the microphone correlation matrix H represents characteristics regarding a spatial frequency direction of K three-dimensional tensors of Rank 1.

After the three-dimensional tensor is decomposed to K three-dimensional tensors, a spatial frequency mask of each sound source is generated by organizing three-dimensional tensors of the number corresponding to the number of sound sources existing in the sound collection space from the K three-dimensional tensors using a clustering method such as a k-means method.

Typical multichannel NMF is disclosed in, for example, "Hiroshi Sawada, Hirokazu Kameoka, Shoko Araki, Naonori Ueda, "Multichannel Extensions of Non-Negative Matrix Factorization With Complex-Valued Data," IEEE Transactions on Audio, Speech & Language Processing 21(5): 971-982 (2013)" (hereinafter, also referred to as a Literature 1).

A cost function and updating equations for matrix estimation of sound source separation performed at the sound source separating unit 66 will be described below while compared with the multichannel NMF disclosed in Literature 1.

A cost function L(T, V, H) of the multichannel NMF using an Itakura, Saito pseudo distance can be expressed as the following equation (11).

[Math. 11]

$$L(T, V, H) = \sum_{i,j} \left(tr(X_{ij}X'^{-1}_{ij}) + \log\det(X'_{ij})\right) \tag{11}$$

Note that, in the equation (11), tr( ) indicates trace, and det( ) indicates a determinant. Further, $X_{ij}$ is a microphone correlation matrix on a time-frequency at a frequency bin i and a frame j of an input signal. The microphone correlation matrix is a matrix formed with elements indicating correlation between microphones constituting the microphone array, that is, between channels.

Note that the frequency bin i and the frame j correspond to the above-described time-frequency spectral index $n_T$ and time frame index 1.

The microphone correlation matrix $X_{ij}$ is expressed as the following equation (12) using a time-frequency spectral matrix $S''_{nT,1}$ which is expression of a matrix of the zero padded time-frequency spectrum $S''(m_S, n_T, 1)$.

[Math. 12]

$$X_{ij} = S''_{nT,1} S''^{H}_{nT,1} \tag{12}$$

Further, $X'_{ij}$ in the equation (11) is an estimated microphone correlation matrix which is an estimated value of the microphone correlation matrix $X_{ij}$, and this estimated microphone correlation matrix $X'_{ij}$ is expressed with the following equation (13).

[Math. 13]

$$X'_{ij} = \sum_k H_{ik} t_{ik} v_{kj} \tag{13}$$

In the equation (13), $H_{ik}$ indicates an estimated microphone correlation matrix which is an estimated microphone correlation matrix H at the frequency bin i and the base k, and $t_{ik}$ indicates an estimated element of the frequency matrix T at the frequency bin i and the base k. Further, $v_{kj}$ indicates an estimated element of a time matrix V at the base k and the frame j.

Further, an updating equation for matrix estimation of the multichannel NMF is expressed as the following equation (14) to equation (16).

[Math. 14]

$$t_{ik} = t_{ik}^{prev} \sqrt{\frac{\sum_j tr(X'^{-1}_{ij} X_{ij} X'^{-1}_{ij} H_{ik}) v_{kj}}{\sum_j tr(X'^{-1}_{ij} H_{ik}) v_{kj}}} \tag{14}$$

[Math. 15]

$$v_{kj} = v_{kj}^{prev} \sqrt{\frac{\sum_j tr(X'^{-1}_{ij} X_{ij} X'^{-1}_{ij} H_{ik}) t_{ik}}{\sum_j tr(X'^{-1}_{ij} H_{ik}) t_{ik}}} \tag{15}$$

[Math. 16]

$$H_{ik}\left(\sum_j X'^{-1}_{ij} v_{kj}\right) H_{ik} = H_{ik}^{prev}\left(\sum_j X'^{-1}_{ij} X_{ij} X'^{-1}_{ij} v_{kj}\right) H_{ik}^{prev} \tag{16}$$

Note that, in the equation (14), $t_{ik}^{prev}$ indicates an element $t_{ik}$ before updating, in the equation (15), $v_{kj}^{prev}$ indicates an element $v_{kj}$ before updating, and, in the equation (16), $H_{ik}^{prev}$ indicates an estimated microphone correlation matrix $H_{ik}$ before updating.

In the multichannel NMF disclosed in Literature 1, the cost function L(T, V, H) indicated in the equation (11) is minimized while the frequency matrix T, the time matrix V and the microphone correlation matrix H are updated using each updating equation indicated in the equation (14) to the equation (16).

By learning the frequency matrix T, the time matrix V and the microphone correlation matrix H in this manner, K three-dimensional tensors, that is, a tensor in which K bases k have characteristics of one sound source is provided.

However, in the multichannel NMF disclosed in Literature 1, an inverse matrix of the estimated microphone correlation matrix $X'_{ij}$ have to be calculated using all the updating equations indicated with the equation (14) to the equation (16). Further, updating of the estimated microphone correlation matrix $H_{ik}$ requires calculation of an algebraic Riccati equation. Therefore, in the multichannel NMF disclosed in Literature 1, calculation cost of sound source separation becomes high. That is, a calculation amount increases.

Meanwhile, at the sound source separating unit 66, a multichannel sound collection signal subjected to spatial frequency transform by the Fourier base matrix F, that is, the spatial frequency spectral matrix $S'_{nT,1}$ indicated in the above-described equation (9) is used for sound source separation.

In this case, the cost function L(T, V, H) becomes as expressed with the following equation (17).

[Math. 17]

$$L(T, V, H) = \sum_{i,j}\left(tr\left(F^H X_{ij} F\left(\sum_k F^H H_{ik} F t_{ik} v_{kj}\right)^{-1}\right) + \log\det\left(\sum_k F^H H_{ik} F t_{ik} v_{kj}\right)\right) \tag{17}$$

Note that, in the equation (17), tr( ) indicates trace, and det( ) indicates a determinant. Further, T, V and H respectively indicate a frequency matrix T, a time matrix V and a microphone correlation matrix H, and $X_{ij}$ is a microphone correlation matrix on a time-frequency at a frequency bin i and a frame j of a sound collection signal. Here, the frequency bin i and the frame j correspond to the above-described time-frequency spectral index $n_T$ and time frame index 1.

Further, in the equation (17), $H_{ik}$ indicates an estimated microphone correlation matrix which is an estimated microphone correlation matrix H at the frequency bin i and the base k, and $t_{ik}$ indicates an estimated element of the frequency matrix T at the frequency bin i and the base k. Further, $v_{kj}$ indicates an estimated element of the time matrix V at the base k and the frame j. $F_H$ is an Hermitian transposed matrix of the Fourier base matrix F.

Note that, here, an example will be described where the spatial frequency spectrum $S'(n_S, n_T, 1)$ is regarded as a three-dimensional tensor, and is decomposed to K three-dimensional tensors of Rank 1. Therefore, each three-dimensional tensor, that is, an index k indicating each base is k=1, 2, . . . , K.

Here, from the above-described equation (9) and equation (12), the microphone correlation matrix $A_{ij}$ of the sound collection signal on the spatial frequency can be expressed as the following equation (18) using the Fourier base matrix F and the microphone correlation matrix $X_{ij}$ of the sound collection signal on the time-frequency.

[Math. 18]

$$\begin{aligned} A_{ij} &= S'_{nT} \cdot lS'^{H}_{nT.l} = (F^H S''_{nT.l})(F^H S''_{nT.l})^H \\ &= F^H S''_{nT.l} S''^{H}_{nT.l} F = F^H X_{ij} F \end{aligned} \tag{18}$$

In a similar manner, an estimated microphone correlation matrix $B_{ik}$ on the spatial frequency can be expressed as the following equation (19) using the estimated microphone correlation matrix $H_{ik}$ on the time-frequency.

[Math. 19]

$$B_{ik} = F^H H_{ik} F \tag{19}$$

Therefore, from these microphone correlation matrix $A_{ij}$ and estimated microphone correlation matrix $B_{ik}$, the cost function L(T, V, H) expressed with the equation (17) can be expressed as the following equation (20). Note that, in the cost function L(T, V, B) indicated in the equation (20), the microphone correlation matrix H of the cost function L(T, V, H) is substituted with the microphone correlation matrix B corresponding to the estimated microphone correlation matrix $B_{ik}$.

[Math. 20]

$$L(T, V, B) = \sum_{i,j}\left(tr\left(A_{ij}\left(\sum_k B_{ik} t_{ik} v_{kj}\right)^{-1}\right) + \log\det\left(\sum_k B_{ik} t_{ik} v_{kj}\right)\right) \tag{20}$$

Further, updating equations for matrix estimation in the case where a multichannel sound collection signal subjected to spatial frequency transform using the Fourier base matrix F are as expressed with the following equation (21) to equation (23).

[Math. 21]

$$t_{ik} = t_{ik}^{prev}\sqrt{\frac{\sum_j tr(A'^{-1}_{ij} A_{ij} A'^{-1}_{ij} B_{ik}) v_{kj}}{\sum_j tr(A'^{-1}_{ij} B_{ik}) v_{kj}}} \tag{21}$$

[Math. 22]

$$v_{kj} = v_{kj}^{prev}\sqrt{\frac{\sum_i tr(A'^{-1}_{ij} A_{ij} A'^{-1}_{ij} B_{ik}) t_{ik}}{\sum_j tr(A'^{-1}_{ij} B_{ik}) t_{ik}}} \tag{22}$$

[Math. 23]

$$B_{ik}\left(\sum_j A'^{-1}_{ij} v_{kj}\right) B_{ik} = B_{ik}^{prev}\left(\sum_j A'^{-1}_{ij} A_{ij} A'^{-1}_{ij} v_{kj}\right) B_{ik}^{prev} \tag{23}$$

Note that, in the equation (21), $t_{ik}^{prev}$ indicates an element $t_{ik}$ before updating, in the equation (22), $v_{kj}^{prev}$ indicates an element $v_{kj}$ before updating, and, in the equation (23), $B_{ik}^{prev}$ indicates an estimated microphone correlation matrix $B_{ik}$ before updating.

Further, in the equation (21) to the equation (23), $A'_{ij}$ indicates an estimated microphone correlation matrix which is an estimated value of the microphone correlation matrix $A_{ij}$.

For example, it is assumed that the number of microphones $N_{mic}$ which is the number of microphones constituting the microphone array 61 is equal to or larger than 32, that is, there are $N_{mic} \geq 32$ observation points, and the microphone correlation matrix $A_{ij}$ and the estimated microphone correlation matrix $B_{ik}$ are sufficiently diagonalized.

In such a case, updating equations expressed in the equation (21) to the equation (23) are simplified, and are expressed as the following equation (24) to equation (26). That is, calculation of an inverse matrix is approximated by division of a diagonal component, and as a result, the equation (21) to the equation (23) are approximated as in equation (24) to equation (26).

[Math. 24]

$$t_{ik} = t_{ik}^{prev}\sqrt{\frac{\sum_{c,j} \frac{a_{cij}}{a'^2_{cij}} b_{cik} v_{kj}}{\sum_{c,j} \frac{1}{a'_{cij}} b_{cik} v_{kj}}} \tag{24}$$

-continued

[Math. 25]

$$v_{kj} = v_{kj}^{prev}\sqrt{\frac{\sum_{c,i} \frac{a_{cij}}{a'^2_{cij}} b_{cik} t_{ik}}{\sum_{c,i} \frac{1}{a'_{cij}} b_{cik} t_{ik}}} \tag{25}$$

[Math. 26]

$$b_{cik} = b_{cik}^{prev}\sqrt{\frac{\sum_j \frac{a_{cij}}{a'^2_{cij}} t_{ik} v_{kj}}{\sum_j \frac{1}{a'_{cij}} t_{ik} v_{kj}}} \tag{26}$$

Note that, in the equation (24) to the equation (26), c indicates an index of a diagonal component, corresponding to a spatial frequency spectral index. Further, $a_{cij}$, $a'_{cij}$ and $b_{cik}$ respectively indicate elements of indexes C of the microphone correlation matrix $A_{ij}$, the estimated microphone correlation matrix $A'_{ij}$ and the estimated microphone correlation matrix $B_{ik}$. Further, $b_{cik}^{prev}$ indicates an element $b_{cik}$ before updating.

In calculation of the updating equations expressed in these equation (24) to equation (26), because calculation of an inverse matrix and calculation of an algebraic Riccati equation are not required, calculation cost becomes $O(N_{mic})$, so that it is possible to substantially reduce a calculation amount. As a result, it is possible to separate a sound source at lower calculation cost.

The spatial frequency mask generating unit 81 of the sound source separating unit 66 minimizes the cost function L(T,V,B) expressed in the equation (20) while updating the frequency matrix T, the time matrix V and the microphone correlation matrix B using the updating equations expressed in the equation (24) to the equation (26).

By learning the frequency matrix T, the time matrix V and the microphone correlation matrix B in this manner, K three-dimensional tensors, that is, a tensor in which K bases k have characteristics of one sound source is provided.

Further, the spatial frequency mask generating unit 81 performs clustering using a k-means method, or the like, using the frequency matrix T, the time matrix V and the microphone correlation matrix B obtained in this manner, and classifies each base k into any of clusters of the number of sound sources in the sound collection space.

The spatial frequency mask generating unit 81 then calculates the following equation (27) for each cluster, that is, for each sound source on the basis of a result of the clustering and calculates a spatial frequency mask $g_{cij}$ for extracting a component of the sound source.

[Math. 27]

$$g_{cij} = \frac{\sum_{k \in C_1} b_{cik} t_{ik} v_{kj}}{\sum_{k=1}^{K} b_{cik} t_{ik} v_{kj}} \tag{27}$$

Note that, in the equation (27), $C_1$ indicates an element group of the base k classified into a cluster corresponding to a sound source to be extracted. Therefore, the spatial frequency mask $g_{cij}$ can be obtained by dividing a sum of $b_{cik}t_{ik}v_{kj}$ of the bases k classified into the cluster corresponding to the sound source to be extracted by a sum of $b_{cik}t_{ik}v_{kj}$ of all the bases k.

Further, for example, the multichannel NMF is also disclosed in "Joonas Nikunen, Tuomas Virtanen, "Direction of Arrival Based Spatial Covariance Model for Blind Sound Source Separation," IEEE/ACM Transactions on Audio, Speech & Language Processing 22(3): 727-739 (2014)" (hereinafter, also referred to as Literature 2).

More specifically, Literature 2 discloses a multichannel NMF using a direction of arrival (DOA) kernel as a template of a microphone correlation matrix.

Also in the case where such a DOA kernel is used, by applying the present technology so that sound source separation is performed after spatial frequency transform, it is possible to obtain an effect similar to an effect obtained in the case where the present technology is applied to the above-described Literature 1.

Updating equations for matrix estimation in the case where the DOA kernel is used will be described below. However, while a Euclidean distance is used as a cost function in Literature 2, here, updating equations in the case where the Itakura, Saito pseudo distance is used will be described.

Further, it is assumed that a steering vector correlation matrix $W_{io}$ is diagonalized using the following equation (28) assuming that a steering vector correlation matrix for each frequency bin i and for each angle o is $W_{io}$.

[Math. 28]

$$D_{io}=F^{H}W_{io}F \tag{28}$$

Further, a diagonal component of a matrix $D_{io}$ is expressed as $d_{cio}$ using an index c of a diagonal element corresponding to the spatial frequency spectral index.

In such a case, updating equations for matrix estimation are expressed as the following equation (29) to equation (31).

[Math. 29]

$$t_{ik} = t_{ik}^{prev}\sqrt{\frac{\sum_{c,j,o}\frac{a_{cij}}{a'^{2}_{cij}}d_{cio}z_{ko}v_{kj}}{\sum_{c,j,o}\frac{1}{a'_{cij}}d_{cio}z_{ko}v_{kj}}} \tag{29}$$

[Math. 30]

$$v_{kj} = v_{kj}^{prev}\sqrt{\frac{\sum_{c,i,o}\frac{a_{cij}}{a'^{2}_{cij}}d_{cio}z_{ko}t_{ik}}{\sum_{c,i,o}\frac{1}{a'_{cij}}d_{cio}z_{ko}t_{ik}}} \tag{30}$$

[Math. 31]

$$d_{cio} = d_{cio}^{prev}\sqrt{\frac{\sum_{j,k}\frac{a_{cij}}{a'^{2}_{cij}}z_{ko}t_{ik}v_{kj}}{\sum_{j,k}\frac{1}{a'_{cij}}z_{ko}t_{ik}v_{kj}}} \tag{31}$$

Note that, in the equation (29) to the equation (31), $z_{ko}$ expresses weight of a spatial frequency DOA kernel matrix for each angle o of the base k. Further, in the equation (31), $d_{cio}^{prev}$ indicates an element $d_{cio}$ before updating.

The spatial frequency mask generating unit 81 minimizes the cost function while updating the frequency matrix T, the time matrix V and the steering vector correlation matrix D corresponding to the matrix $D_{io}$ using the updating equations expressed in the equation (29) to the equation (31). Note that the cost function used here is a function similar to the cost function indicated in the equation (20).

The spatial frequency mask generating unit 81 performs clustering using a k-means method, or the like, using the frequency matrix T, the time matrix V and the steering vector correlation matrix D obtained in this manner and classifies each base k into any of clusters of the number of sound sources in the sound collection space. That is, clustering is performed so that each base is classified in accordance with a component of a direction of the weight $z_{ko}$.

Further, the spatial frequency mask generating unit 81 calculates the following equation (32) for each cluster, that is, for each sound source on the basis of a result of the clustering and calculates a spatial frequency mask $g_{cij}$ for extracting a component of the sound source.

[Math. 32]

$$g_{cij} = \frac{\sum_{k\in C_1}\sum_{o=1}^{O} d_{cio}z_{ko}t_{ik}v_{kj}}{\sum_{k=1}^{K}\sum_{o=1}^{O} d_{cio}z_{ko}t_{ik}v_{kj}} \tag{32}$$

Note that, in the equation (32), $C_1$ indicates a component group of the base k classified into a cluster corresponding to the sound source to be extracted.

Therefore, the spatial frequency mask $g_{cij}$ can be obtained by dividing a sum of $d_{cio}z_{ko}t_{ik}v_{kj}$ of respective angles of the bases k classified into the cluster corresponding to the sound source to be extracted by a sum of $d_{cio}z_{ko}t_{ik}v_{kj}$ of respective angles for all the bases k.

Note that, hereinafter, the spatial frequency mask $g_{cij}$ indicated in the equation (27) and the equation (32) will be described as a spatial frequency mask $G(n_S, n_T, 1)$ in accordance with the spatial frequency spectrum $S'(n_S, n_T, 1)$.

Here, the index c of the diagonal component in the spatial frequency mask $g_{cij}$, the frequency bin i and the frame j respectively correspond to the spatial frequency spectral index $n_S$, the time-frequency spectral index $n_T$ and the time frame index 1.

When the spatial frequency mask $G(n_S, n_T, 1)$ is obtained at the spatial frequency mask generating unit 81, the sound source separating unit 66 calculates the following equation (33) on the basis of the spatial frequency mask $G(n_S, n_T, 1)$ and the spatial frequency spectrum $S'(n_S, n_T, 1)$ and performs sound source separation.

[Math. 33]

$$S_{sp}(n_S, n_T, 1)=G(n_S, n_T, 1)S'(n_S, n_T, 1) \tag{33}$$

That is, the sound source separating unit 66 extracts only a sound source component corresponding to the spatial frequency mask $G(n_S, n_T, 1)$ by multiplying the spatial frequency spectrum $S'(n_S, n_T, 1)$ by the spatial frequency mask $G(n_S, n_T, 1)$, as an estimated sound source spectrum $S_{SP}(n_S, n_T, 1)$.

As described with reference to FIG. 2, the spatial frequency mask $G(n_S, n_T, 1)$ obtained using the equation (27) and the equation (32) is a spatial frequency mask for masking a component of a predetermined region in a spatial frequency domain and removing other components. Processing of sound source extraction using such a spatial frequency mask $G(n_S, n_T, 1)$ is filtering processing using a Wiener filter.

The sound source separating unit 66 supplies the estimated sound source spectrum $S_{SP}(n_S, n_T, 1)$ obtained through sound source separation to the drive signal generating unit 67.

As described above, the sound source separating unit 66 performs optimization calculation of sound source separation by utilizing a fact that values are converged at a diagonal component in the microphone correlation matrix on the spatial frequency, and using a multichannel sound collection signal transformed into a spatial frequency spectrum.

In this case, when the number of microphones $N_{mic} \geq 32$, even if calculation of an inverse matrix is approximated by division of a diagonal component, performance of sound source separation is less likely to degrade, and, because calculation cost of optimization calculation of sound source separation becomes $O(N_{mic})$, processing speed becomes substantially fast. Therefore, it is possible to separate a sound source more quickly at lower calculation cost without degrading performance of separation at the sound source separating unit 66.

Further, in the case where a Fourier base (plane wave base) is used in spatial frequency transform, a plane wave observed at a linear microphone array which is the microphone array 61 is observed as an impulse in the spatial frequency domain. Therefore, the observed plane wave is expressed more sparsely, in sound source separation such as multichannel NMF in which it is assumed that a signal has sparse characteristics, improvement of separation accuracy can be expected.

(Drive Signal Generating Unit)

The drive signal generating unit 67 will be described next.

The drive signal generating unit 67 obtains a speaker drive signal $D_{SP}(m_S, n_T, 1)$ in a spatial frequency domain for reproducing a sound field (wavefront) from the estimated sound source spectrum $S_{SP}(n_S, n_T, 1)$ which is a spatial frequency spectrum supplied from the sound source separating unit 66.

Specifically, the drive signal generating unit 67 calculates the speaker drive signal $D_{SP}(m_S, n_T, 1)$ which is a spatial frequency spectrum using a spectral division method (SDM) by calculating the following equation (34).

[Math. 34]

$$D_{SP}(m_S, n_T, l) = \begin{cases} 4i\dfrac{\exp\left(-i\sqrt{\left(\frac{\omega}{c}\right)^2 - k^2 y_{ref}}\right)}{H_0^{(2)}\left(\sqrt{\left(\frac{\omega}{c}\right)^2 - k^2 y_{ref}}\right)} S_{SP}(n_S, n_T, l) & \text{for } 0 \leq |k| < \left|\frac{\omega}{c}\right| \\ 2\pi\dfrac{\exp\left(-i\sqrt{k^2 - \left(\frac{\omega}{c}\right)^2 y_{ref}}\right)}{K_0\left(\sqrt{k^2 - \left(\frac{\omega}{c}\right)^2 y_{ref}}\right)} S_{SP}(n_S, n_T, l) & \text{for } 0 \leq \left|\frac{\omega}{c}\right| < |k| \end{cases} \quad (34)$$

Note that, in the equation (34), $y_{ref}$ indicates a reference distance of the SDM, and the reference distance $y_{ref}$ is a position where a wavefront is accurately reproduced. This reference distance $y_{ref}$ is a distance in a direction vertical to a direction that the microphones constituting the microphone array 61 are arranged. For example, here, while the reference distance $y_{ref}=1$ [m], the reference distance may be other values.

Further, in the equation (34), $H_0^{(2)}$ indicates a Hankel function of second kind, and $K_0$ indicates a Bessel function. Further, in the equation (34), i indicates a pure imaginary number, c indicates sound velocity, and ω indicates a temporal radian frequency.

Further, in the equation (34), k indicates a spatial frequency, $m_S$, $n_T$, 1 respectively indicate a spatial frequency spectral index, a time-frequency spectral index and a time frame index.

Note that, while a method for calculating the speaker drive signal $D_{SP}(m_S, n_T, 1)$ using the SDM has been described as an example here, the speaker drive signal may be calculated using other methods. Further, the SDM is disclosed in detail, particularly, in "Jens Adrens, Sascha Spors, "Applying the Ambisonics Approach on Planar and Linear Arrays of Loudspeakers", in $2^{nd}$ International Symposium on Ambisonics and Spherical Acoustics".

The drive signal generating unit 67 supplies the speaker drive signal $D_{SP}(m_S, n_T, 1)$ obtained as described above to the spatial frequency synthesis unit 68.

(Spatial Frequency Synthesis Unit)

The spatial frequency synthesis unit 68 performs spatial frequency synthesis on the speaker drive signal $D_{SP}(m_S, n_T, 1)$ supplied from the drive signal generating unit 67, that is, performs inverse spatial frequency transform on the speaker drive signal $D_{SP}(m_S, n_T, 1)$ by calculating the following equation (35) to calculate a time-frequency spectrum $D(n_{spk}, n_T, 1)$. In the equation (35), discrete Fourier transform (DFT) is performed as the inverse spatial frequency transform.

[Math. 35]

$$D(n_{spk}, n_T, l) = \sum_{m_S=0}^{M_S-1} D_{SP}(m_S, n_T, l)\exp\left(-i2\pi\frac{m_S n_{spk}}{M_S}\right) \quad (35)$$

Note that, in the equation (35), $n_{spk}$ indicates a speaker index for specifying a speaker included in the speaker array 70. Further, $M_S$ indicates the number of points of DFT, and i indicates a pure imaginary number.

The time-frequency synthesis unit 68 supplies the time-frequency spectrum D(nspk, nT, 1) obtained in this manner to the time-frequency synthesis unit 69.

(Time-frequency Synthesis Unit)

The time-frequency synthesis unit 69 performs time-frequency synthesis of the time-frequency spectrum $D(n_{spk}, n_T, 1)$ supplied from the spatial frequency synthesis unit 68 by calculating the following equation (36) to obtain an output frame signal $d_{fr}(n_{spk}, n_{fr}, 1)$. Here, while inverse short time Fourier transform (ISTFT) is used as time-frequency synthesis, it is only necessary to use transform corresponding to inverse transform of time-frequency transform (forward transform) performed at the time-frequency analysis unit 62.

[Math. 36]

$$d_{fr}(n_{spk}, n_{fr}, l) = \frac{1}{M_T}\sum_{m_T=0}^{M_T-1} D'(n_{spk}, m_T, l)\exp\left(i2\pi\frac{n_{fr}m_T}{M_T}\right) \quad (36)$$

Note that D'(nspk, mT, 1) in the equation (36) can be obtained through the following equation (37).

[Math. 37]

$$D'(n_{spk}, m_T, l) = \begin{cases} D'(n_{spk}, m_T, l) & m_T = 0, \ldots, N_T - 1 \\ conj(D(n_{spk}, M_T - m_T, l)) & m_T = N_T, \ldots, M_T - 1 \end{cases} \quad (37)$$

In the equation (36), i indicates a pure imaginary number, and $n_{fr}$ indicates a time index. Further, in the equation (36) and the equation (37), $M_T$ indicates the number of points of ISTFT, and $n_{spk}$ indicates a speaker index.

Further, the time-frequency synthesis unit 69 multiplies the obtained output frame signal $d_{fr}(n_{spk}, n_{fr}, 1)$ by a window function $w_T(n_{fr})$ and performs frame synthesis by performing overlap addition. For example, frame synthesis is performed through calculation of the following equation (38), and an output signal $d(n_{spk}, t)$ is obtained.

[Math. 38]

$$d^{curr}(n_{spk}, n_{fr}+1N_{fr}) = d_{fr}(n_{spk}, n_{fr}, 1)w_T(n_{fr}) + d^{prev}(n_{spk}, n_{fr}+1N_{fr}) \quad (38)$$

Note that, while a window function which is the same as the window function used at the time-frequency analysis unit 62 is used as a window function $w_T(n_{fr})$ to be multiplied by the output frame signal $d_{fr}(n_{spk}, n_{fr}, 1)$, the window function may be a rectangular window when the window is other windows such as a Hamming window.

Further, in the equation (38), while both $d^{prev}(n_{spk}, n_{fr}+1N_{fr})$ and $d^{curr}(n_{spk}, n_{fr}+1N_{fr})$ indicate an output signal $d(n_{spk}, t)$, $d^{prev}(n_{spk}, n_{fr}+1N_{fr})$ indicates a value prior to updating, and $d^{curr}(n_{spk}, n_{fr}+1N_{fr})$ indicates a value after updating.

The time-frequency synthesis unit 69 supplies the output signal $d(n_{spk}, t)$ obtained in this manner to the linear speaker array 70 as a speaker drive signal.

<Description of Sound Field Reproduction Processing>

Flow of processing performed by the spatial frequency sound source separator 41 described above will be described next. The spatial frequency sound source separator 41 performs sound field reproduction processing of reproducing a sound field by collecting a plane wave when collection of the plane wave of sound in the sound collection space is instructed.

The sound field reproduction processing by the spatial frequency sound source separator 41 will be described below with reference to the flowchart of FIG. 4.

In step S11, the microphone array 61 collects a plane wave of sound in the sound collection space and supplies a sound collection signal $s(n_{mic}, t)$ which is a multichannel sound signal obtained as a result of the sound collection to the time-frequency analysis unit 62.

In step S12, the time-frequency analysis unit 62 analyzes time-frequency information of the sound collection signal $s(n_{mic}, t)$ supplied from the microphone array 61.

Specifically, the time-frequency analysis unit 62 performs time frame division on the sound collection signal $s(n_{mic}, t)$, multiplies an input frame signal $s_{fr}(n_{mic}, n_{fr}, 1)$ obtained as a result of the time frame division by the window function $w_T(n_{fr})$ to calculate a window function applied signal $s_w(n_{mic}, n_{fr}, 1)$.

Further, the time-frequency analysis unit 62 performs time-frequency transform on the window function applied signal $s_w(n_{mic}, n_{fr}, 1)$ and supplies a time-frequency spectrum $S(n_{mic}, n_T, 1)$ obtained as a result of the time-frequency transform to the spatial frequency analysis unit 63. That is, calculation of the equation (4) is performed to calculate the time-frequency spectrum $S(n_{mic}, n_T, 1)$.

In step S13, the spatial frequency analysis unit 63 performs spatial frequency transform on the time-frequency spectrum $S(n_{mic}, n_T, 1)$ supplied from the time-frequency analysis unit 62 and supplies a spatial frequency spectrum $S'(n_S, n_T, 1)$ obtained as a result of the spatial frequency transform to the communication unit 64.

Specifically, the spatial frequency analysis unit 63 transforms the time-frequency spectrum $S(n_{mic}, n_T, 1)$ into the spatial frequency spectrum $S'(n_S, n_T, 1)$ by calculating the equation (5).

In step S14, the communication unit 64 transmits the spatial frequency spectrum $S'(n_S, n_T, 1)$ supplied from the spatial frequency analysis unit 63 to a receiver 52 disposed in the reproduction space through wireless communication. Then, in step S15, the communication unit 65 of the receiver 52 receives the spatial frequency spectrum $S'(n_S, n_T, 1)$ transmitted through wireless communication and supplies the spatial frequency spectrum $S'(n_S, n_T, 1)$ to the sound source separating unit 66. That is, in step S15, the spatial frequency spectrum $S'(n_S, n_T, 1)$ is acquired from the transmitter 51 at the communication unit 65.

In step S16, the spatial frequency mask generating unit 81 of the sound source separating unit 66 generates a spatial frequency mask $G(n_S, n_T, 1)$ through blind sound source separation on the basis of the spatial frequency spectrum $S'(n_S, n_T, 1)$ supplied from the communication unit 65.

For example, the spatial frequency mask generating unit 81 minimizes the cost function indicated in the equation (20), or the like, while updating each matrix using the updating equations indicated in the above-described equation (24) to equation (26) or equation (29) to equation (31). The spatial frequency mask generating unit 81 then performs clustering on the basis of the matrix obtained through minimization of the cost function and obtains the spatial frequency mask $G(n_S, n_T, 1)$ indicated in the equation (27) or the equation (32).

Note that, an example has been described here where the present technology is applied to the above-described Literature 1 or Literature 2, and the spatial frequency mask $G(n_S, n_T, 1)$ is calculated by performing nonnegative matrix factorization (nonnegative tensor decomposition) in the spatial frequency domain as the blind sound source separation. However, any processing may be performed if the processing is processing of calculating the spatial frequency mask in the spatial frequency domain.

In step S17, the sound source separating unit 66 extracts a sound source on the basis of the spatial frequency spectrum $S'(n_S, n_T, 1)$ supplied from the communication unit 65 and the spatial frequency mask $G(n_S, n_T, 1)$ and supplies the estimated sound source spectrum $S_{SP}(n_S, n_T, 1)$ obtained as a result of the extraction to the drive signal generating unit 67.

For example, in step S17, the equation (33) is calculated to extract a component of a desired sound source from the spatial frequency spectrum $S'(n_S, n_T, 1)$ as the estimated sound source spectrum $S_{SP}(n_S, n_T, 1)$.

Note that, a spatial frequency mask $G(n_S, n_T, 1)$ of which sound source is used may be designated by a user, or the like, or may be determined in advance from the spatial frequency masks $G(n_S, n_T, 1)$ generated for each sound source in step S17. Further, a component of one sound source may be extracted or components of a plurality of sound sources may be extracted from the spatial frequency spectrum $S'(n_S, n_T, 1)$.

In step S18, the drive signal generating unit 67 calculates a speaker drive signal $D_{SP}(m_S, n_T, 1)$ in the spatial frequency domain on the basis of the estimated sound source spectrum $S_{SP}(n_S, n_T, 1)$ supplied from the sound source separating unit 66 and supplies the speaker drive signal $D_{SP}(m_S, n_T, 1)$ to the spatial frequency synthesis unit 68. For example, the drive signal generating unit 67 calculates the speaker drive signal $D_{SP}(m_S, n_T, 1)$ in the spatial frequency domain by calculating the equation (34).

In step S19, the spatial frequency synthesis unit 68 performs inverse spatial frequency transform on the speaker drive signal $D_{SP}(m_S, n_T, 1)$ supplied from the drive signal generating unit 67 and supplies the time-frequency spectrum $D(n_{spk}, n_T, 1)$ obtained as a result of the inverse spatial frequency transform to the time-frequency synthesis unit 69. For example, the spatial frequency synthesis unit 68 performs inverse spatial frequency transform by calculating the equation (35).

In step S20, the time-frequency synthesis unit 69 performs time-frequency synthesis of the time-frequency spectrum $D(n_{spk}, n_T, 1)$ supplied from the spatial frequency synthesis unit 68.

Specifically, the time-frequency synthesis unit 69 calculates an output frame signal $d_{fr}(n_{spk}, n_{fr}, 1)$ from the time-frequency spectrum $D(n_{spk}, n_T, 1)$ by performing calculation of the equation (36). Further, the time-frequency synthesis unit 69 performs calculation of the equation (38) by multiplying the output frame signal $d_{fr}(n_{spk}, n_{fr}, 1)$ by the window function $w_T(n_{fr})$ to calculate an output signal $d(n_{spk}, t)$ through frame synthesis.

The time-frequency synthesis unit 69 supplies the output signal $d(n_{spk}, t)$ obtained in this manner to the speaker array 70 as a speaker drive signal.

In step S21, the speaker array 70 reproduces sound on the basis of the speaker drive signal supplied from the time-frequency synthesis unit 69, and the sound field reproduction processing ends. When sound is reproduced on the basis of the speaker drive signal in this manner, a sound field in sound collection space is reproduced in reproduction space.

As described above, the spatial frequency sound source separator 41 generates a spatial frequency mask through blind sound source separation on the spatial frequency spectrum and extracts a component of a desired sound source from the spatial frequency spectrum using the spatial frequency mask.

By generating the spatial frequency mask through blind sound source separation on the spatial frequency spectrum in this manner, it is possible to separate an arbitrary sound source at lower cost.

<Second Embodiment>

<Configuration Example of Spatial Frequency Sound Source Separator>

Note that, while an example has been described above where a spatial frequency mask is generated through blind sound source separation at the sound source separating unit 66, in the case where information regarding a desired sound source to be extracted located in the sound collection space is supplied, a sound source may be separated using the information regarding the desired sound source. Here, examples of the information regarding the desired sound source can include a direction where a sound source to be extracted is located in the sound collection space, that is, target direction information indicating an arrival direction of a propagation wave from the sound source to be extracted.

Figure 5:
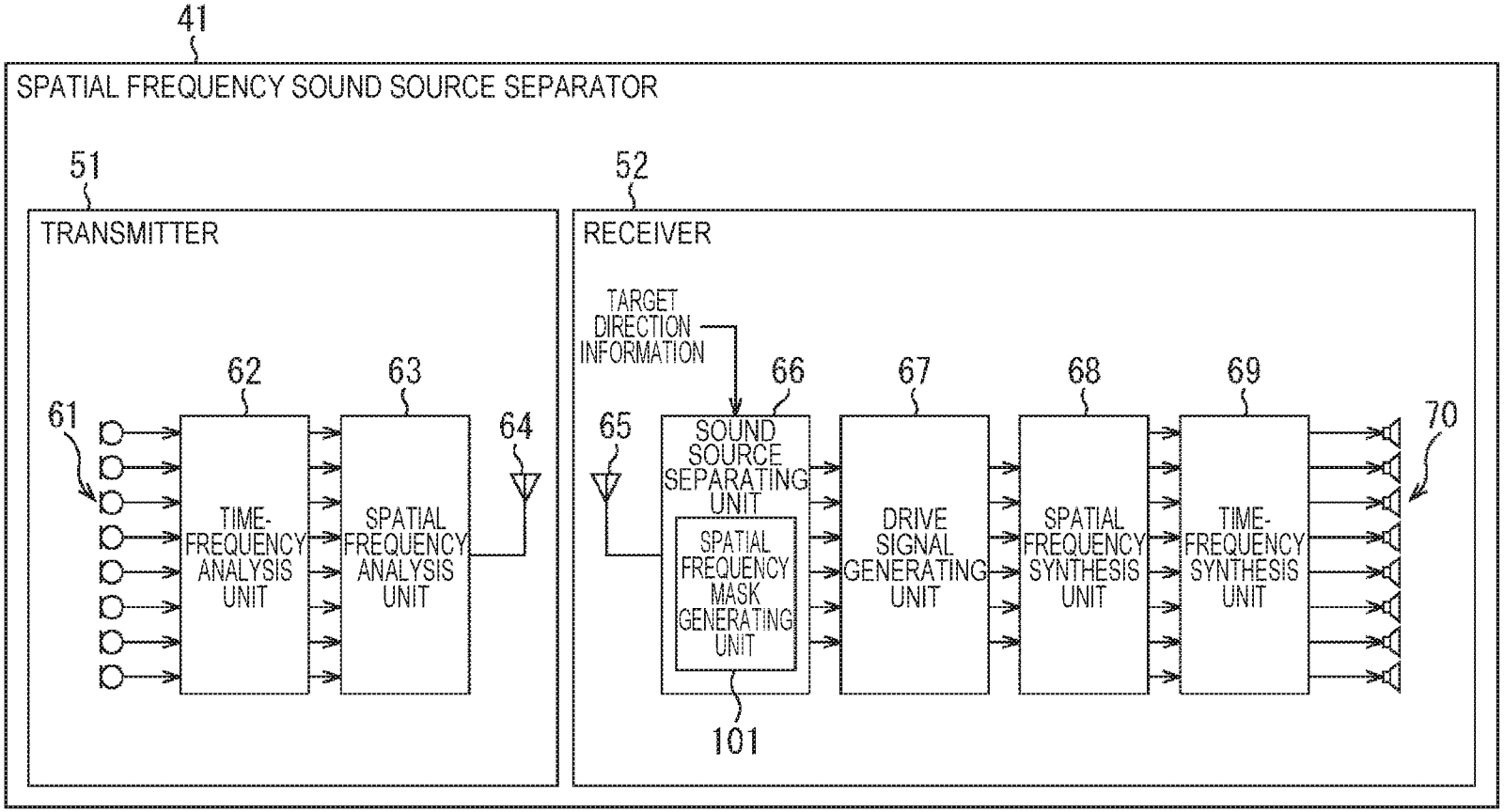
FIG. 5 is a diagram illustrating a configuration example of a spatial frequency sound source separator.

In such a case, the spatial frequency sound source separator 41 is configured as illustrated in, for example, FIG. 5. Note that, in FIG. 5, the same reference numerals are assigned to components corresponding to the components in FIG. 3, and explanation thereof will be omitted.

The configuration of the spatial frequency sound source separator 41 illustrated in FIG. 5 is the same as the configuration of the spatial frequency sound source separator 41 in FIG. 3 except that the spatial frequency mask generating unit 101 is provided at the sound source separating unit 66 in place of the spatial frequency mask generating unit 81 illustrated in FIG. 3.

In the spatial frequency sound source separator 41 in FIG. 5, target direction information is supplied to the sound source separating unit 66 from outside. Here, the target direction information may be any information if a direction of a sound source to be extracted in the sound collection space, that is, an arrival direction of a propagation wave (sound) from the sound source which is a target can be specified from the information.

The spatial frequency mask generating unit 101 generates a spatial frequency mask through sound source separation using information on the basis of the supplied target direction information and the spatial frequency spectrum supplied from the communication unit 65.

More specifically, for example, at the spatial frequency mask generating unit 101, it is possible to enable the spatial frequency mask to be generated using a minimum variance beam former which is one of adaptive beam formers.

A coefficient $w_{ij}$ of the minimum variance beam former is expressed as the following equation (39).

[Math. 39]

$$W_{ij} = \frac{R_{ij}^{-1} a}{a^H R_{ij}^{-1} a} \tag{39}$$

Note that, in the equation (39), a indicates a DOA kernel, and this DOA kernel a is obtained by the target direction information.

Further, in the equation (39), $R_{ij}$ is a microphone correlation matrix at the frequency bin i and the frame j, and the frequency bin i and the frame j respectively correspond to the time-frequency spectral index $n_T$ and the time frame index 1. This microphone correlation matrix $R_{ij}$ is the same as the microphone correlation matrix $X_{ij}$ indicated in the equation (12).

Meanwhile, a coefficient $G_{ij}$ of the minimum variance beam former using the multichannel sound collection signal subjected to spatial frequency transform can be expressed as the following equation (40) using $A_{ij}=F^H R_{ij}^F$ and $b=F^H a$ for the microphone correlation matrix $R_{ij}$ and the DOA kernel a in the equation (39). Note that, in the equation (40), an inverse matrix of the matrix $A_{ij}$ is simplified (approximated) as division of a diagonal component.

[Math. 40]

$$G_{ij} = \frac{A_{ij}^{-1} b}{b^H A_{ij}^{-1} b} \tag{40}$$

Further, the coefficient can be expressed as the following equation (41) if expressed as a matrix assuming that an index of a diagonal component corresponding to the spatial frequency spectral index is c (where c=1, 2, . . . , C).

[Math. 41]

$$G_{ij}=[g_{1ij}, g_{2ij}, \ldots, g_{cij}]^T \tag{41}$$

In this event, a component $g_{cij}$ constituting the coefficient $G_{ij}$ indicated in the equation (41) becomes a spatial frequency mask, and a sound source can be extracted through the above-described equation (33) if this spatial frequency mask $g_{cij}$ is described as the spatial frequency mask $G(n_S, n_T, 1)$ in accordance with the spatial frequency spectrum $S'(n_S, n_T, 1)$.

<Description of Sound Field Reproduction Processing>

Figure 6:
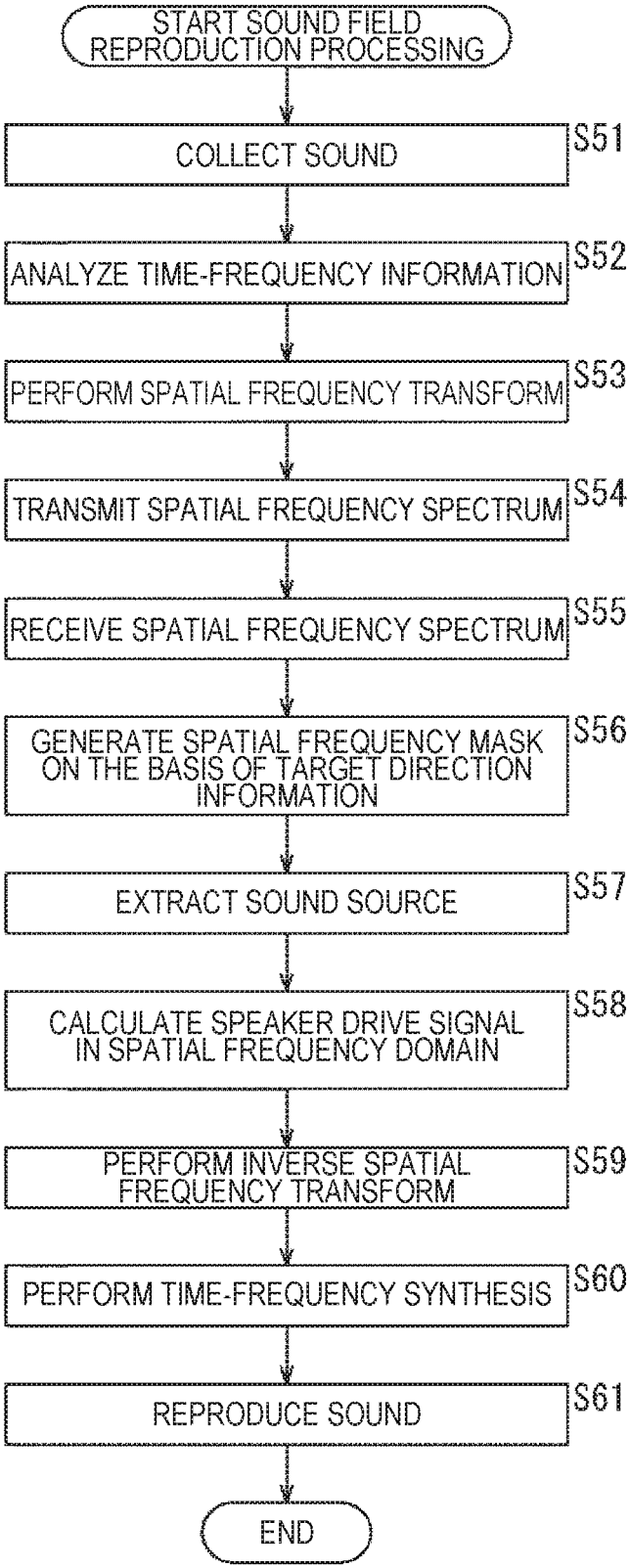
FIG. 6 is a flowchart explaining sound field reproduction processing according to an embodiment of the present technology.

The sound field reproduction processing performed by the spatial frequency sound source separator 41 illustrated in FIG. 5 will be described next with reference to the flowchart in FIG. 6.

Figure 4:
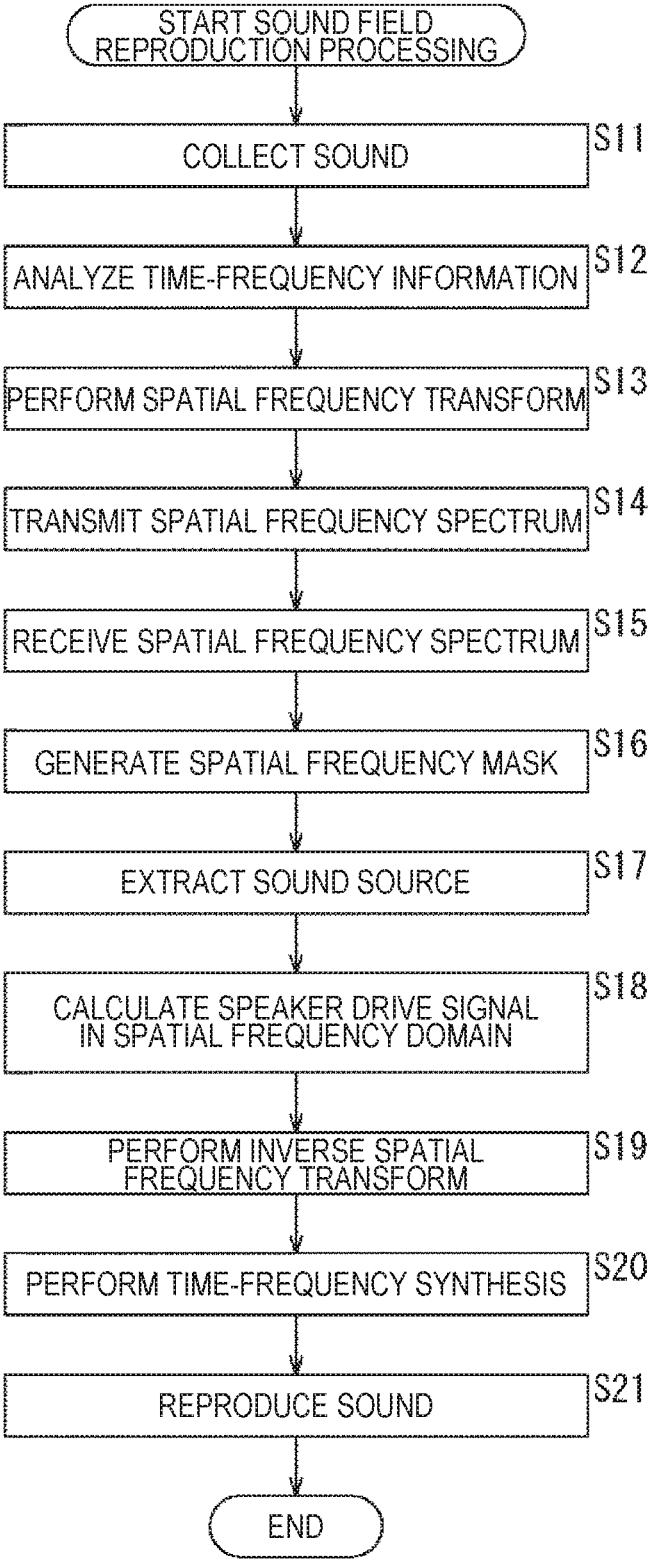
FIG. 4 is a flowchart explaining sound field reproduction processing according to an embodiment of the present technology.

Note that, because the processing from step S51 to step S55 is similar to processing from step S11 to step S15 in FIG. 4, explanation thereof will be omitted.

In step S56, the spatial frequency mask generating unit 101 of the sound source separating unit 66 generates a spatial frequency mask $G(n_S, n_T, 1)$ through sound source separation using information on the basis of the spatial frequency spectrum $S'(n_S, n_T, 1)$ supplied from the communication unit 65 and the target direction information supplied from outside.

For example, the spatial frequency mask generating unit 101 calculates $A_{ij}=F^H R_{ij} F$ using the spatial frequency spectrum $S'(n_S, n_T, 1)$ and further calculates the equation (40), thereby obtains a spatial frequency mask $G(n_S, n_T, 1)$ of the sound source to be extracted, specified by the target direction information.

If the spatial frequency mask $G(n_S, n_T, 1)$ is obtained, while processing from step S57 to step S61 is performed and the sound field reproduction processing is finished after that, because these processing is similar to the processing from step S17 to step S21 in FIG. 4, explanation thereof will be omitted.

As described above, the spatial frequency sound source separator 41 generates a spatial frequency mask for the spatial frequency spectrum through sound source separation using target direction information and extracts a component of a desired sound source from the spatial frequency spectrum using the spatial frequency mask.

By the spatial frequency mask being generated through sound source separation using a minimum variance beam former, or the like, with respect to the spatial frequency spectrum in this manner, it is possible to separate an arbitrary sound source at lower cost.

The series of processes described above can be executed by hardware but can also be executed by software. When the series of processes is executed by software, a program that constructs such software is installed into a computer. Here, the expression "computer" includes a computer in which dedicated hardware is incorporated and a general-purpose personal computer or the like that is capable of executing various functions when various programs are installed.

Figure 7:
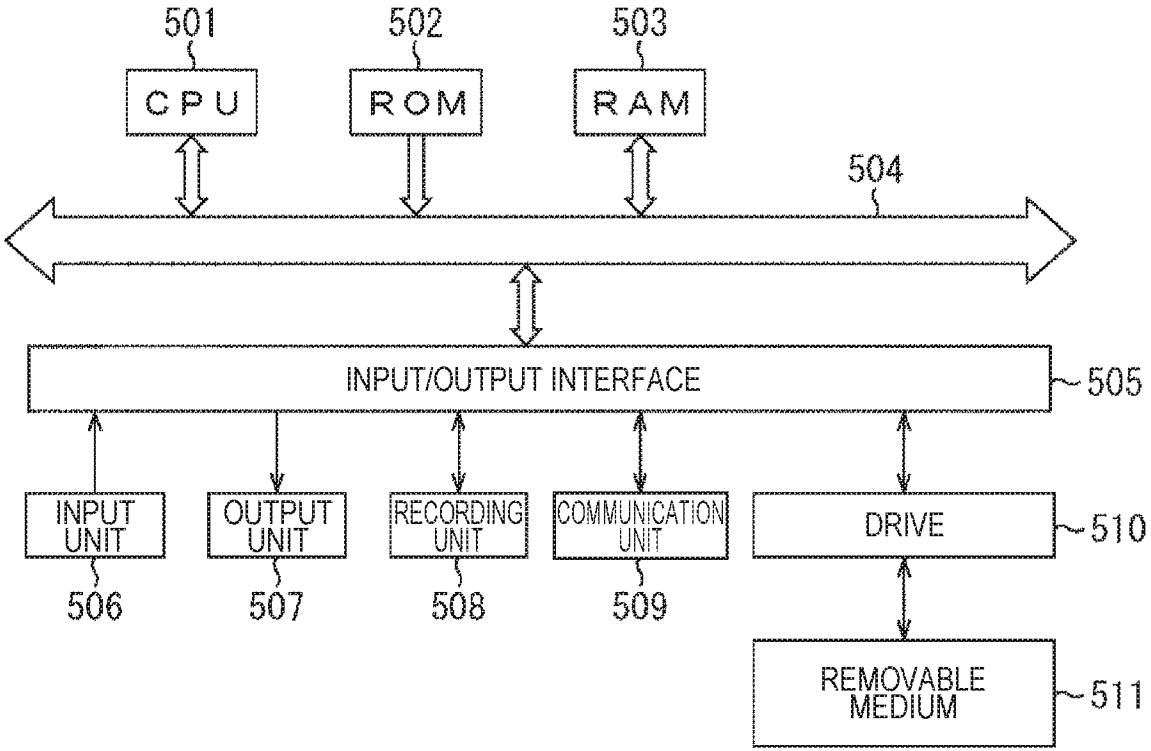
FIG. 7 is a diagram illustrating a configuration example of a computer according to an embodiment of the present technology.

FIG. 7 is a block diagram showing an example configuration of the hardware of a computer that executes the series of processes described earlier according to a program.

In a computer, a CPU 501, a ROM (Read Only Memory) 502, and a RAM (Random Access Memory) 503 are mutually connected by a bus 504.

An input/output interface 505 is also connected to the bus 504. An input unit 506, an output unit 507, a recording unit 508, a communication unit 509, and a drive 510 are connected to the input/output interface 505.

The input unit 506 is configured from a keyboard, a mouse, a microphone, an imaging element or the like. The output unit 507 configured from a display, a speaker or the like. The recording unit 508 is configured from a hard disk, a non-volatile memory or the like. The communication unit 509 is configured from a network interface or the like. The drive 510 drives a removable medium 511 such as a magnetic disk, an optical disk, a magneto-optical disk, a semiconductor memory or the like.

In the computer configured as described above, as one example the CPU 501 loads a program recorded in the recording unit 508 via the input/output interface 505 and the bus 504 into the RAM 503 and executes the program to carry out the series of processes described earlier.

As one example, the program executed by the computer (the CPU 501) may be provided by being recorded on the removable medium 511 as a packaged medium or the like. The program can also be provided via a wired or wireless transfer medium, such as a local area network, the Internet, or a digital satellite broadcast.

In the computer, by loading the removable medium 511 into the drive 510, the program can be installed into the recording unit 508 via the input/output interface 505. It is also possible to receive the program from a wired or wireless transfer medium using the communication unit 509 and install the program into the recording unit 508. As another alternative, the program can be installed in advance into the ROM 502 or the recording unit 508.

Note that the program executed by the computer may be a program in which processes are carried out in a time series in the order described in this specification or may be a program in which processes are carried out in parallel or at necessary timing, such as when the processes are called.

An embodiment of the disclosure is not limited to the embodiments described above, and various changes and modifications may be made without departing from the scope of the disclosure.

For example, the present disclosure can adopt a configuration of cloud computing which processes by allocating and connecting one function by a plurality of apparatuses through a network.

Further, each step described by the above-mentioned flow charts can be executed by one apparatus or by allocating a plurality of apparatuses.

In addition, in the case where a plurality of processes are included in one step, the plurality of processes included in this one step can be executed by one apparatus or by sharing a plurality of apparatuses.

Additionally, the present technology may also be configured as below.

(1)

A sound source separation apparatus including:

an acquiring unit configured to acquire a spatial frequency spectrum of a multichannel sound signal obtained by collecting sound using a microphone array;

a spatial frequency mask generating unit configured to generate a spatial frequency mask for masking a component of a predetermined region in a spatial frequency domain on the basis of the spatial frequency spectrum; and a sound source separating unit configured to extract a component of a desired sound source from the spatial frequency spectrum as an estimated sound source spectrum on the basis of the spatial frequency mask.

(2)

The sound source separation apparatus according to (1), in which the spatial frequency mask generating unit generates the spatial frequency mask through blind sound source separation.

(3)

The sound source separation apparatus according to (2), in which the spatial frequency mask generating unit generates the spatial frequency mask through the blind sound source separation utilizing nonnegative matrix factorization.

(4)

The sound source separation apparatus according to (1), in which the spatial frequency mask generating unit generates the spatial frequency mask through sound source separation using information relating to the desired sound source.

(5)

The sound source separation apparatus according to (4), in which the information relating to the desired sound source is information indicating a direction of the desired sound source.

(6)

The sound source separation apparatus according to (5), in which the spatial frequency mask generating unit generates the spatial frequency mask using an adaptive beam former.

(7)

The sound source separation apparatus according to any one of (1) to (6), further including:

a drive signal generating unit configured to generate a drive signal in a spatial frequency domain for reproducing sound based on the sound signal on the basis of the estimated sound source spectrum;

a spatial frequency synthesis unit configured to perform spatial frequency synthesis on the drive signal to calculate a time-frequency spectrum; and a time-frequency synthesis unit configured to perform time-frequency synthesis on the time-frequency spectrum to generate a speaker drive signal for reproducing the sound using a speaker array.

(8)

A sound source separation method including the steps of:

acquiring a spatial frequency spectrum of a multichannel sound signal obtained by collecting sound using a microphone array;

generating a spatial frequency mask for masking a component of a predetermined region in a spatial frequency domain on the basis of the spatial frequency spectrum; and extracting a component of a desired sound source from the spatial frequency spectrum as an estimated sound source spectrum on the basis of the spatial frequency mask.

(9)

A program causing a computer to execute processing including the steps of:

acquiring a spatial frequency spectrum of a multichannel sound signal obtained by collecting sound using a microphone array;

generating a spatial frequency mask for masking a component of a predetermined region in a spatial frequency domain on the basis of the spatial frequency spectrum; and extracting a component of a desired sound source from the spatial frequency spectrum as an estimated sound source spectrum on the basis of the spatial frequency mask.

REFERENCE SIGNS LIST

41 spatial frequency sound source separator
51 transmitter
52 receiver
61 microphone array
62 time-frequency analysis unit
63 spatial frequency analysis unit
64 communication unit
65 communication unit
66 sound source separating unit
67 drive signal generating unit
68 spatial frequency synthesis unit
69 time-frequency synthesis unit
70 speaker array
81 spatial frequency mask generating unit
101 spatial frequency mask generating unit

The invention claimed is:

1. A sound source separation apparatus, comprising:

a central processing unit (CPU) configured to:

obtain a multichannel sound signal via a microphone array;

generate a spatial frequency spectrum based on the multichannel sound signal;

generate a spatial frequency mask to mask a component of a specific region in a spatial frequency domain, wherein the spatial frequency mask is generated based on:

a direction of arrival of the multichannel sound signal from a specific sound source, and the spatial frequency spectrum; and extract, as an estimated sound source spectrum, a component of the specific sound source based on a multiplication of the spatial frequency spectrum with the spatial frequency mask.

2. The sound source separation apparatus according to claim 1, wherein the CPU is further configured to generate the spatial frequency mask through blind sound source separation.

3. The sound source separation apparatus according to claim 2, wherein the CPU is further configured to generate the spatial frequency mask through the blind sound source separation by utilization of non-negative matrix factorization.

4. The sound source separation apparatus according to claim 1, wherein the CPU is further configured to generate the spatial frequency mask through sound source separation based on information associated with the specific sound source.

5. The sound source separation apparatus according to claim 4, wherein the information associated with the specific sound source indicates the direction of arrival.

6. The sound source separation apparatus according to claim 5, wherein the CPU is further configured to generate the spatial frequency mask based on an adaptive beam former.

7. The sound source separation apparatus according to claim 1, wherein the CPU is further configured to:

generate a drive signal in the spatial frequency domain based on the estimated sound source spectrum;

reproduce the multichannel sound signal based on the drive signal;

calculate a time-frequency spectrum based on spatial frequency synthesis on the drive signal;

generate a speaker drive signal based on time frequency synthesis on the time-frequency spectrum; and reproduce, via a speaker array, the multichannel sound signal based on the speaker drive signal.

8. A sound source separation method, comprising:

obtaining a multichannel sound signal via a microphone array;

generating a spatial frequency spectrum based on the multichannel sound signal;

generating a spatial frequency mask for masking a component of a specific region in a spatial frequency domain, wherein the spatial frequency mask is generated based on:

a direction of arrival of the multichannel sound signal from a specific sound source, and the spatial frequency spectrum; and extracting, as an estimated sound source spectrum, a component of the specific sound source based on a multiplication of the spatial frequency spectrum with the spatial frequency mask.

9. A non-transitory computer-readable medium having stored thereon computer-executable instructions that, when executed by a processor, cause the processor to execute operations, the operations comprising:

obtaining a multichannel sound signal via a microphone array;

generating a spatial frequency spectrum based on the multichannel sound signal;

generating a spatial frequency mask for masking a component of a specific region in a spatial frequency domain, wherein the spatial frequency mask is generated based on:

a direction of arrival of the multichannel sound signal from a specific sound source, and the spatial frequency spectrum; and extracting, as an estimated sound source spectrum, a component of the specific sound source based on a multiplication of the spatial frequency spectrum with the spatial frequency mask.

* * * * *